US006196246B1

(12) United States Patent
Folsom

(10) Patent No.: US 6,196,246 B1
(45) Date of Patent: Mar. 6, 2001

(54) FREEZE-RESISTANT PLUMBING SYSTEM IN COMBINATION WITH A BACKFLOW PREVENTER

(76) Inventor: William D. Folsom, 26518 Border St., Spring, TX (US) 77373

( * ) Notice: Subject to any disclaimer, the term of this patent is extended or adjusted under 35 U.S.C. 154(b) by 0 days.

(21) Appl. No.: 09/349,569

(22) Filed: Jul. 8, 1999

Related U.S. Application Data

(63) Continuation-in-part of application No. 09/049,832, filed on Mar. 27, 1998, now Pat. No. 5,950,653.

(51) Int. Cl.[7] ..... E03B 7/12; F16K 17/04; F16L 53/00

(52) U.S. Cl. ..... 137/2; 137/14; 137/62; 137/115.13; 137/115.18; 137/218; 137/334; 137/340; 137/512.3; 137/564; 137/565.15; 137/565.29; 137/565.33; 122/504; 237/80; 417/14

(58) Field of Search ..... 137/59, 62, 1, 137/2, 334, 337, 340, 564, 565.01, 565.13, 14, 115.13, 115.18, 218, 512, 512.3, 565.15, 565.29, 565.33; 126/362.1, 588; 237/80; 417/32, 2, 14, 26; 122/19.1, 504

(56) References Cited

U.S. PATENT DOCUMENTS

| | | | | |
|---|---|---|---|---|
| 3,420,252 | * | 1/1969 | Stroble | 137/59 |
| 4,453,534 | * | 6/1984 | Kazimir | 126/588 |
| 4,456,024 | | 6/1984 | Roberts | 137/62 |
| 4,457,326 | * | 7/1984 | Donnelly | 137/59 |
| 4,481,966 | * | 11/1984 | Anderson | 137/59 |
| 4,531,538 | * | 7/1985 | Sandt et al. | 137/334 |
| 4,606,325 | * | 8/1986 | Lujan Jr. | 126/362 |
| 4,672,990 | | 6/1987 | Robillard | 137/59 |
| 5,220,937 | * | 6/1993 | Roberts et al. | 137/62 |
| 5,226,441 | * | 7/1993 | Dunmire et al. | 137/15.01 |
| 5,287,876 | | 2/1994 | Takahaski | 137/62 |
| 5,318,059 | | 6/1994 | Lyons | 137/62 |
| 5,385,166 | * | 1/1995 | Dunmire et al. | 137/15.08 |
| 5,488,968 | | 2/1996 | Price et al. | 137/1 |

* cited by examiner

*Primary Examiner*—George L. Walton
(74) *Attorney, Agent, or Firm*—Mary J. Gaskin

(57) ABSTRACT

A plumbing system which, when ambient outdoor temperatures drop below freezing, circulates water to prevent it from freezing, utilizing a check valve to prevent water from flowing back into the water main and further utilizing a relief valve which can open to the atmosphere and relieve pressure in the system if necessary. The system can have two separate circulation pumps, one for hot water and one for cold water.

7 Claims, 5 Drawing Sheets

FREEZE-RESISTANT PLUMBING SYSTEM IN COMBINATION WITH A BACKFLOW PREVENTER

RELATED APPLICATION DATA

This application is a continuation-in-part of U.S. patent application, Ser. No. 09/049,832, filed on Mar. 27, 1998, now U.S. Pat. No. 5,950,653, the content of this reference is incorporated herein in its entirety.

FIELD OF THE INVENTION

The present invention relates generally to freeze-resistant plumbing systems in structures located in areas where the ambient temperature declines to a point below freezing, causing water within existing plumbing systems to freeze and damage or destroy the plumbing systems.

BACKGROUND OF THE INVENTION

In cold climates, water in plumbing systems tends to freeze and expand when exposed to temperatures below freezing. When structures are vacant or when water pipes are either exposed or located in attics or exterior walls, the expansion of frozen water may cause the pipes to rupture, leading to water damage when the pipes thaw and water flow resumes.

Keeping water moving throughout the system is effective in preventing water from freezing in the pipes during a cold spell. Hence, people open faucets to drip, maintaining water movement. However, this practice wastes water and may cause water pressure problems.

Prior art methods use circulating water to prevent frozen pipes. U.S. Pat. No. 4,672,990 describes a system with restrictive connections between the hot water and cold water supply lines. However, migration of water between the lines would result in "warm" cold water and "cool" hot water. Further, the increased pressure caused by the circulating pump could pump water back into the main water supply, contaminating it.

U.S. Pat. No. 5,318,059 describes a method of warming cold water by mixing it with hot water and conducting it to the cold water main line. Again, the homeowner would get "warm" cold water or "cool" hot water.

SUMMARY OF THE INVENTION

The present invention is a true water circulatory system, with no expensive branch lines, by-pass lines, shunt lines, or cross-connects. The cold water circulation system is separate from the hot water circulating system, with a separate circulating pump for each system. The system requires no large mixing tanks or space-consuming expansion tanks. When the ambient outdoor temperature drops below a predetermined temperature (e.g. 34° Fahrenheit) a temperature-sensitive switch will energize the circulation pumps, forcing the water to flow continuously through the system. The system operates in conjunction with a backflow preventer with a pressure relief valve; when the circulation pumps are running, the operation of the backflow preventer will prevent water from being pumped back into the main water supply. No pressure relief valve is required for the water heater in this system. Ordinary plumbing materials such as copper and CPVC (chlorinated polyvinyl chloride) pipe are used in building this system. Valves are fixed to the pipes by pipe threads, bolts, flanges, adhesives, welding, or other available means.

It is an object of this invention to provide a freeze-resistant plumbing system for residential and commercial applications.

Yet another object of the invention is to provide a freeze-resistant plumbing system which does not require mixing cold water with hot water in order to prevent freezing.

A further object of the invention is to provide a freeze-resistant plumbing system which is inexpensive to install and operate and which requires little space.

DETAILED DESCRIPTION OF THE PREFERRED EMBODIMENT

Figure 1:
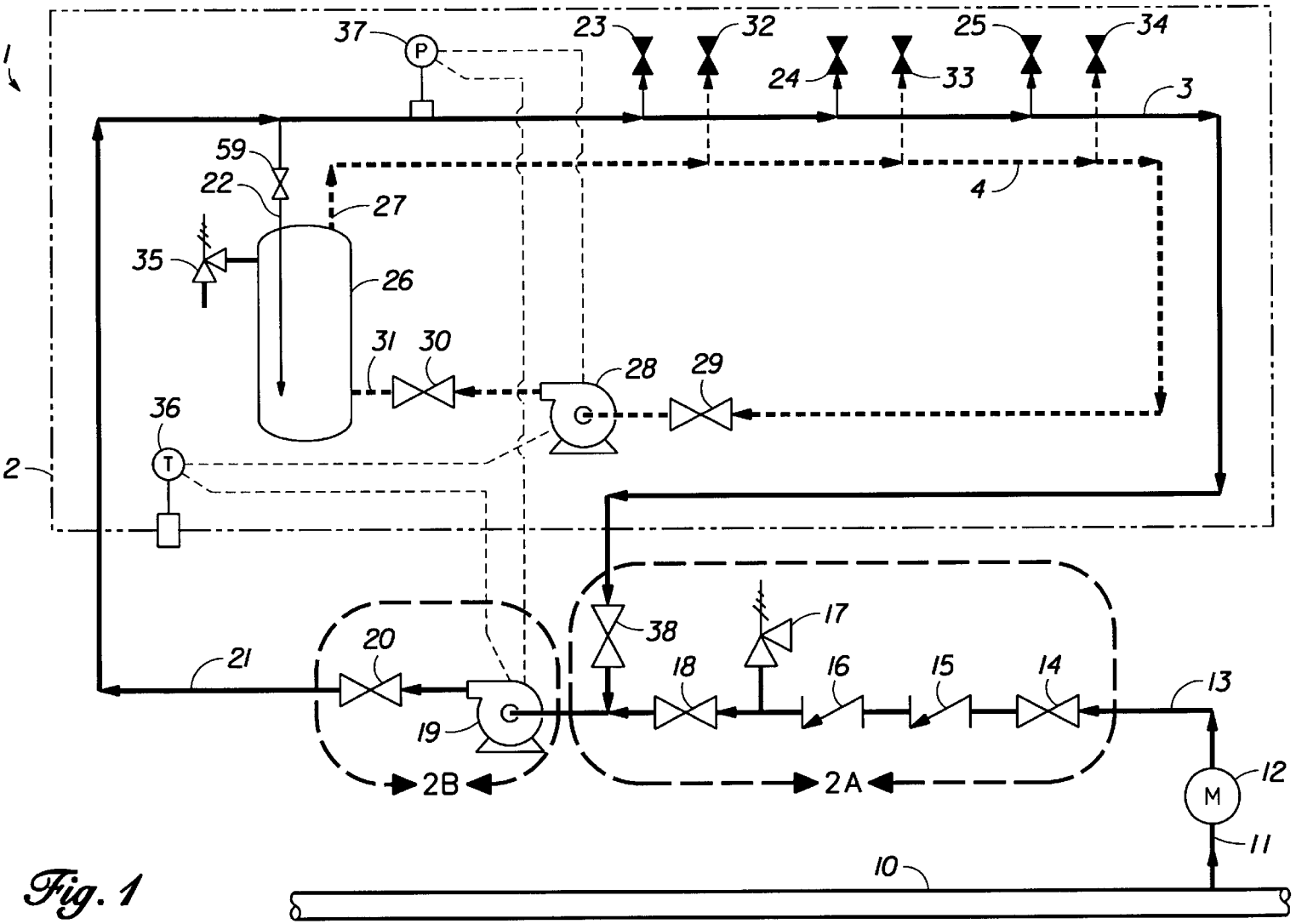
FIG. 1 is a schematic diagram of the system of the preferred embodiment.

Referring to FIG. 1, there is shown a schematic diagram of the plumbing system 1 of the preferred embodiment. The broken rectangle defines a building or structure 2 which utilizes this plumbing system 1. The thick black lines (with directional arrows) defines a cold water pipe system loop 3 in which cold water will circulate when the plumbing system 1 is activated. The thick dashed lines (with directional arrows) define a hot water pipe system loop 4 in which hot water will circulate when the plumbing system is activated.

Water (not seen in this view) flows under pressure from the water main pipe 10 into the intake pipe 11, through the water meter 12, through a line pipe 13, through the first isolation valve 14[1], through the first check valve 15, through the second check valve 16 and past the high pressure relief valve 17, which is normally in a closed position. The water continues flowing through the second isolation valve 18 and through the cold water circulation pump 19. Normally, pressure from the water main 10 maintains the flow of water; the cold water circulation pump 19 is not actuated and water flows without resistance. The water flows from the cold water circulation pump 19 through the third isolation valve 20 and into the cold water service pipe 21, from which it will flow either through takeoff valve 59 into water heater inlet pipe 22 or to first cold water valve outlet 23, or second cold water valve outlet 24, or third cold water valve outlet 25, as people open cold water taps at a sink or shower, or flush a commode. The number of various cold water outlets is by design choice and could number over ten. When the cold water circulation pump 19 is actuated, water flows through fourth isolation valve 38 back to the cold water circulation pump 19. [1]

[1] Isolation valves 14, 18, 20, 29, 30 and 38 allow the interruption of the flow of water within the system of pipes for maintenance purposes.

The water heater inlet pipe 22 is connected to takeoff valve 59 from the cold water service pipe 21 and could be a tee joint or a Yjoint, by design choice. The water heater inlet pipe 22 conducts cold water into the water heater 26 wherein the water is heated and channeled into the hot water service pipe 27. In order to circulate the hot water, a hot water circulation pump 28 is fixed to the hot water service pipe 27 between fifth isolation valve 29 and sixth isolation valve 30. The hot water return pipe 31 returns water to the water heater 26 for reheating. (Hot water circulation pumps are already used in some structures to make hot water immediately available to users.)

The hot water service pipe 27 carries heated water to first hot water valve outlet 32 (possibly a kitchen sink tap), second hot water valve outlet 33 (possibly a bathtub fixture) and third hot water valve outlet 34 (possibly a washing machine line). There could be ten or more hot water valve outlets by design choice.

A water heater pressure relief valve 35 is shown suitably fixed to the water heater 26. The water heater pressure relief valve 35 will allow the pressure in the water heater to escape should the pressure in the water heater 26 rise to a dangerous level. However, if the water heater pressure relief valve 35 fails and the plumbing system 1 becomes over-pressured, the high pressure relief valve 17 would open to atmosphere and would relieve the potentially dangerous high pressure situation.

A temperature switch 36 is shown suitably fixed to the outside wall of structure 2. As the ambient outdoor temperature declines to a predetermined point (i.e. 34° F.), the temperature switch 36 will close and send a signal to actuate the cold water circulation pump 19 and the hot water circulation pump 28, each of which will pump water through its respective loop. As the water flows through the cold water pipe system loop 3 and the hot water pipe system loop 4, the water will be prevented from freezing, meaning no damage will result to pipes from ice formation within the pipes. The pressure of the water circulating throughout the plumbing system 1 may exceed the water pressure from the water main pipe 10; in that event, it will cause the first check valve 15 and the second check valve 16 to close, keeping any contaminated water or water that has passed through the water meter 12 from flowing back into the main water supply system.

A pressure switch 37 is shown suitably fixed to the cold water service pipe 21. The pressure switch 37 will turn off the energy to either the cold water circulation pump 19 and/or the hot water circulation pump 28 if the pressure within the cold water pipe system loop 3 or the hot water pipe system 4 becomes too high as a result of the water heater's 26 over heating water and the pressure relief valve's 35 failing, causing an unsafe increase of pressure within the plumbing system 1.

Figure 2A:
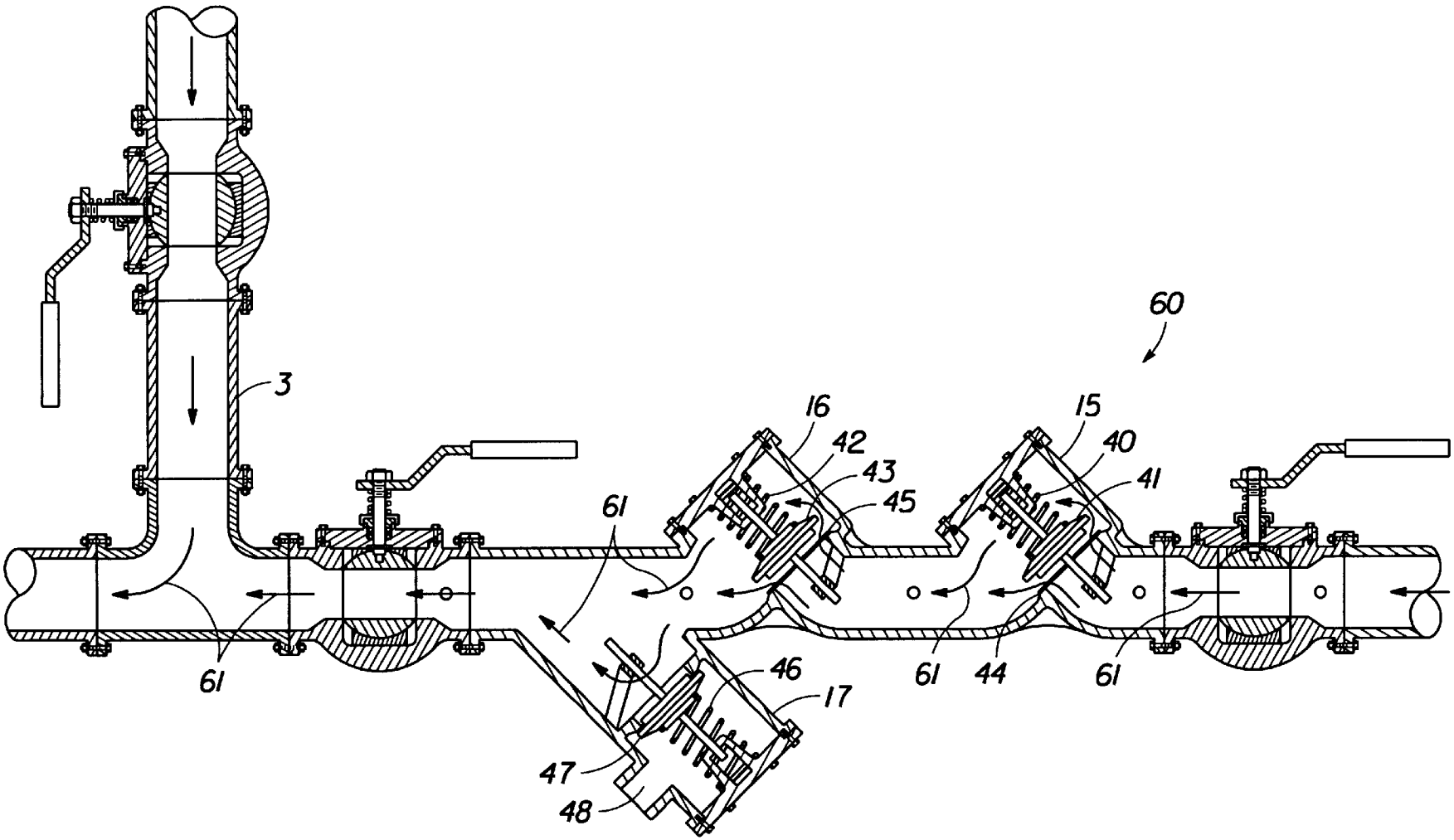
FIG. 2A is a partial view of FIG. 1, showing a section elevational view of the backflow preventer with a high pressure relief valve.

Referring to FIG. 2A, there is shown a section elevational view of normal flow through the pressure relief system 60, which operates to prevent contaminated water under pressure from flowing back into the main water supply system. The water 61 (shown as arrows) flows from the direction of the main water supply system. The water pressure from the water main supply system is greater than the thrust exerted by the first biased spring 40 on the first valve disk 41 in the first check valve 15 and the thrust exerted by the second biased spring 42 on the second valve disk 43 in the second check valve 16. As long as water is being released from one of the cold water valve outlets or one of the hot water valve outlets, water will flow past the first valve disk 41 and second valve disk 43; when the hot water valve outlets are closed and the cold water valve outlets are closed, the first valve disk 41 in the first check valve 15 and the second valve disk 43 in the second check valve 16 will close because pressure within the cold water pipe system loop 3 and the hot water pipe system loop (not shown) will equalize the pressure from the main water supply system; the added thrust from the first biased spring 40 on the first valve disk 41 in the first check valve 15 will cause the first check valve 15 to close or will force the first valve disk 41 to compress on the first valve seat 44, forming a fluid-tight seal; likewise, the added thrust from the second biased spring 42 on the second valve disk 43 in the second check valve 16 will cause the second check valve 16 to close or will force the second valve disk 43 to compress on the second valve seat 45.

Under normal operating conditions, the high pressure relief valve 17 will remain closed; the water pressure from the main water supply system will not be sufficient to overcome the force that the third biased spring 46 exerts on the third valve disk 47, and therefore the third valve disk 47 should form a fluid-tight and pressure-tight seal in the high pressure relief valve 17. When the pressure in the cold water piping system loop 3 and/or the hot water piping system loop 4 exceeds the thrust on the third biased spring 46 in the high pressure relief valve 17, the third valve disk 47 will open and allow the water pressure in both loops to be suitably relieved through high pressure relief port 48.

Figure 2B:
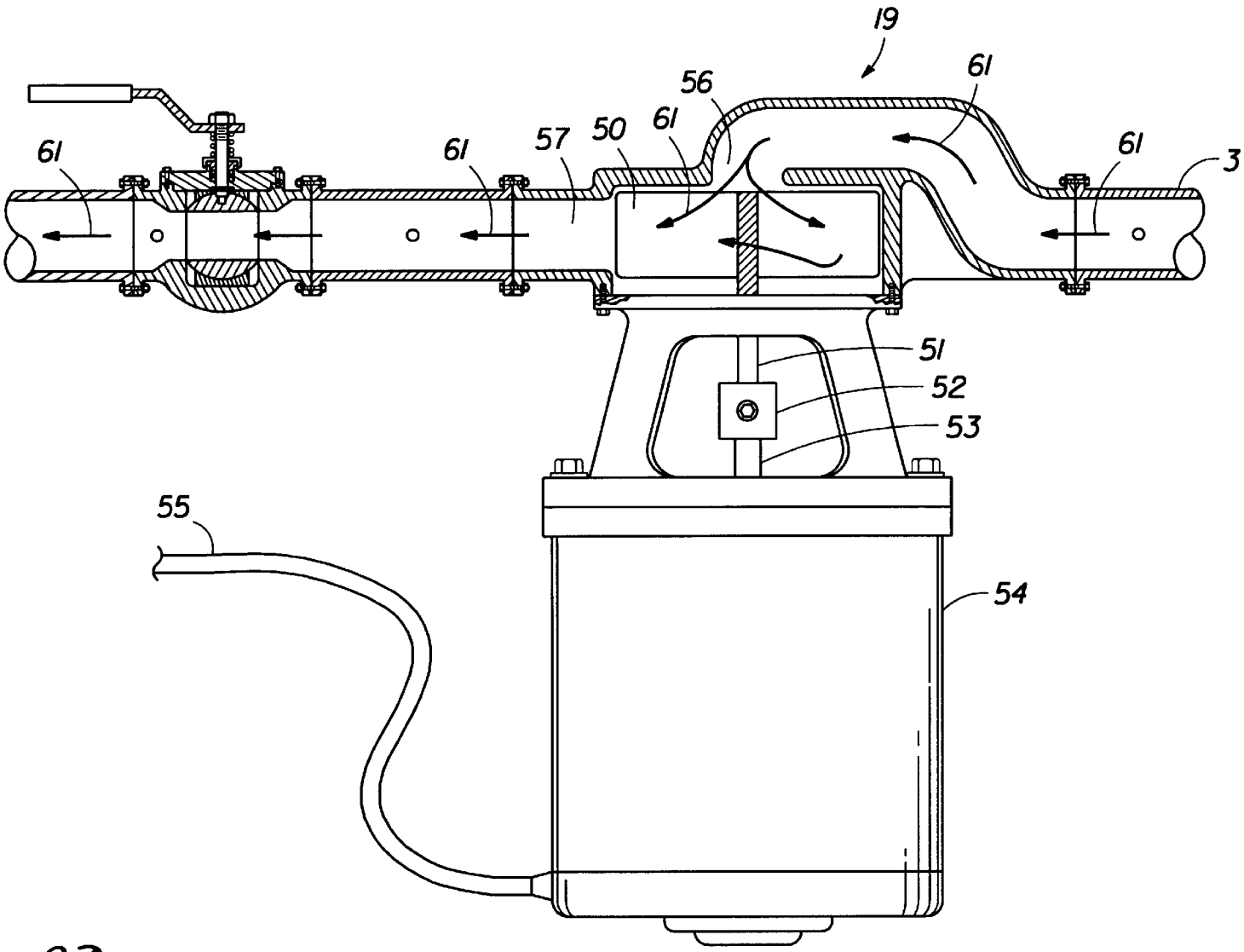
FIG. 2B is a partial view of FIG. 1, showing a section elevational view of the cold water circulation pump.

Referring to FIG. 2B, there is shown a section elevational view of the cold water circulation pump 19 suitably fixed to the cold water pipe system loop 3. The water 61 (shown as arrows) flows in a normal direction, and the cold water circulation pump 19 may or may not be energized and operating at this particular time. The cold water circulation pump 19 is shown with an impeller 50 connected to an impeller shaft 51, a shaft coupling 52 between the impeller shaft 51 and motor shaft 53, and a pump motor 54. The pump motor 54 can also be connected to the impeller shaft 51 by a belt drive, a chain drive, or a magnetic drive, by design choice. The pump motor 54 can be an electric motor, an internal combustion engine, a turbine or any other type of prime mover, by design choice. The pump motor 54 can be connected by power line 55 to AC/DC power or solar power; or an internal combustion engine, powered by gasoline, propane, or natural gas can turn the motor shaft 53 directly. Water enters the cold water circulation pump 19 at suction end 56 and leaves at the discharge end 57.

Figure 3A:
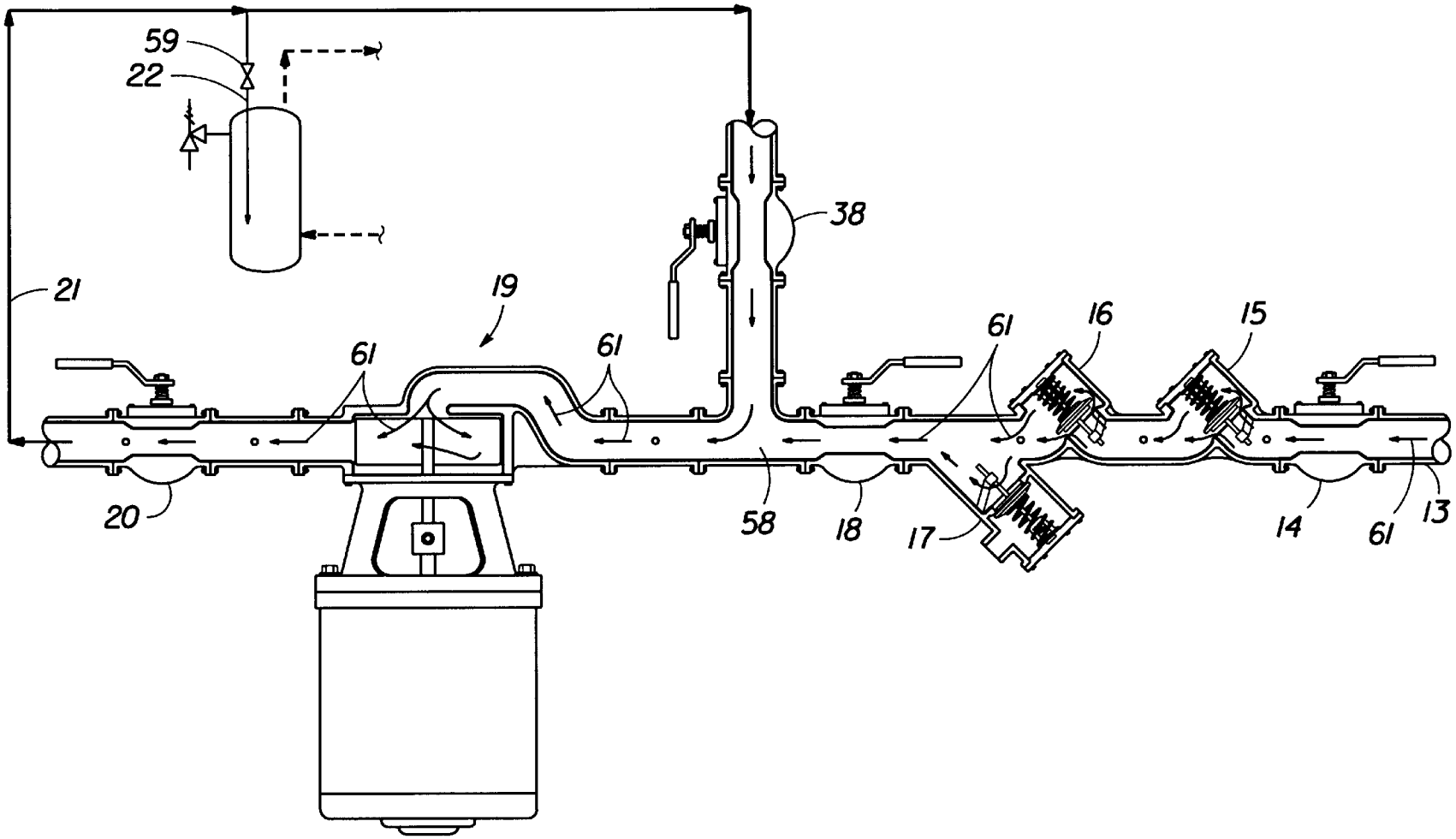
FIG. 3A is a combination section elevational view and schematic diagram of the system of the preferred embodiment during normal operation.

Referring to FIG. 3A, there is shown a combination section elevational view and schematic diagram of the system of the preferred embodiment. The water 61 (shown as arrows) flows from the line pipe 13, through first isolation valve 14, through the first check valve 15 in an open mode, through the second check valve 16 in an open mode, past the high pressure relief valve 17 in a closed mode, through the second isolation valve 18, through the first tee section 58, through the cold water circulation pump 19, through the third isolation valve 20, into the cold water service pipe 21, and through takeoff valve 59 into the water heater inlet pipe 22, out through one of the cold water valve outlets (not shown), or through the fourth isolation valve 38 to complete a loop. The water will flow freely when one of the cold water valve outlets is opened or when one of the hot water valve outlets is opened.

Figure 3B:
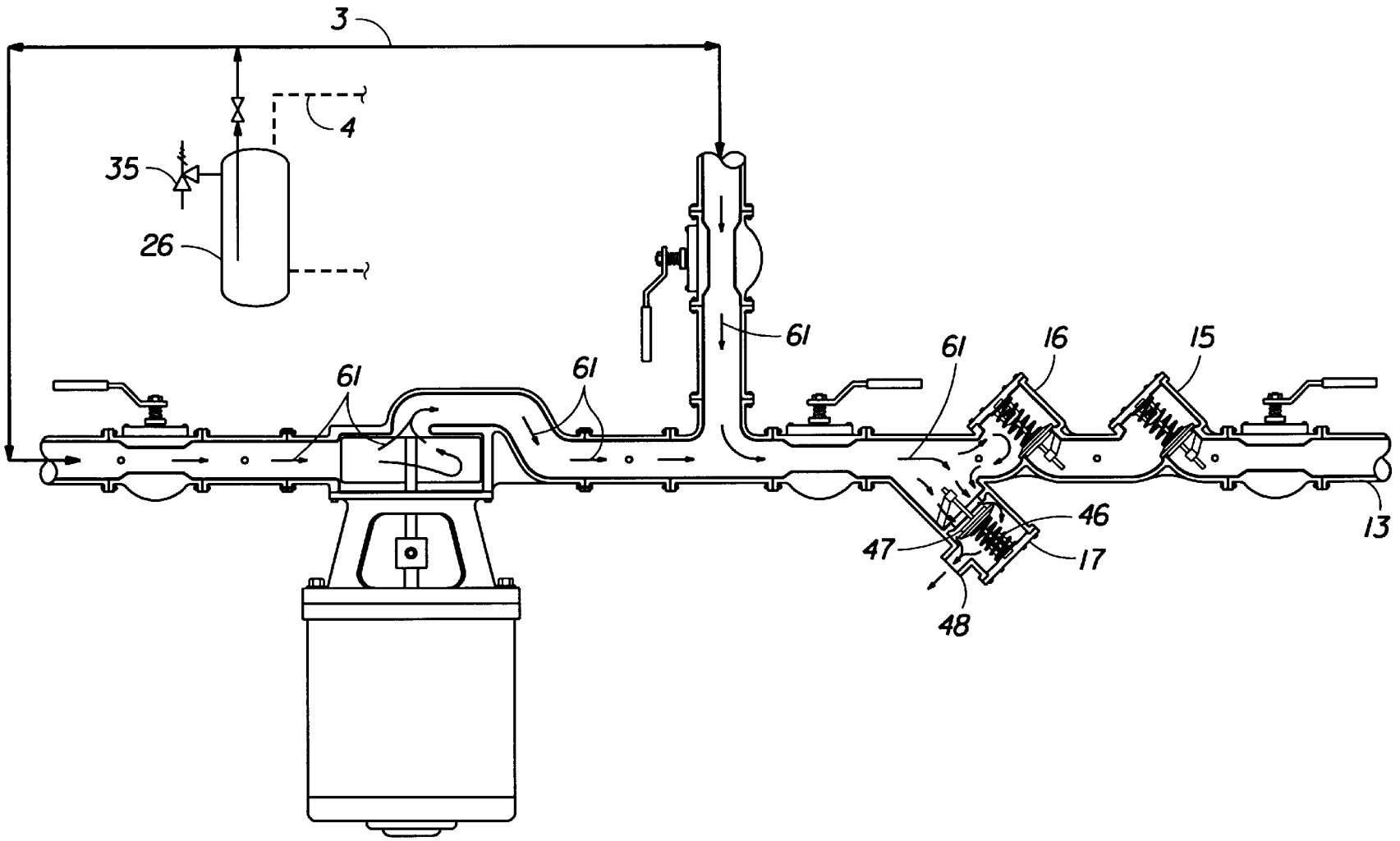
FIG. 3B is a combination section elevational view and schematic diagram of the system of the preferred embodiment in an over-pressure mode.

Referring to FIG. 3B, there is shown a combination section elevational view and schematic diagram of the system of the preferred embodiment in an over-pressure mode. The condition of the system is that the water heater 26 has overheated and the water heater pressure relief valve 35 has malfunctioned (stayed closed or is blocked). The water 61 (shown as arrows) from the water heater 26 has expanded, putting pressure into the hot water pipe system loop 4 and the cold water pipe system loop 3 so that the pressure generated from the overheated water heater 26 is greater than the pressure exerted by the water 61 (shown as arrows) flowing from the main water supply system. The increased water pressure has caused the first check valve 15 and the second check valve 16 to close, thereby preventing any contaminated water from flowing back into the line pipe 13; further the water pressure has become so high that it has overcome the thrust of the third biased spring 46, thereby opening the third valve disk 47 located in high pressure relief valve 17, allowing overheated water to flow past the third valve disk 47, and out of the high pressure relief port 48 into an open area or onto the ground. The release of pressurized hot water in this manner will prevent the water heater 26 from exploding and will further prevent any possibly contaminated water from entering the main water supply system.

Although the system described in detail has been found to be most satisfactory and preferred, many variations are possible. For example, a second set of check valves and pressure relief valves could be built into the hot water system loop 4.

Although the invention has been described with reference to the preferred embodiment, it will be understood by those skilled in the art that additions, modifications, substitutions, deletions and other changes not specifically described are possible, and that the details herein are to be interpreted as illustrative and not as self-limiting.

I claim:

1. A freeze-resistant plumbing system comprising:

a service pipe for supplying water from a water main pipe to at least one water fixture in a structure;

a housing with at least one check valve installed between said service pipe and said water main pipe;

a first circulation pump connected in line with said service pipe, the circulation pump having an outlet and an inlet;

a closed cold water system loop disposed between the outlet and the inlet of the first circulation pump;

an ambient temperature-sensing means which activates said first circulation pump upon sensing an ambient temperature below a predetermined value, causing water untapped by the fixture to circulate continuously through the closed cold water system loop from the outlet to the inlet of the circulation pump at a desired rate to prevent freezing of said water, further causing said check valve to close when circulating water pressure exceeds water pressure in the service pipe, thereby preventing water from flowing back through the service pipe to the water main pipe;

a relief valve assembly in said housing downstream of said check valve disposed in a reverse flow direction, said relief valve assembly having dimensions sufficiently large enough to empty said service pipe and further having a port open to outside atmosphere and a relief valve operable to open position automatically in response to a high pressure condition in said service pipe which exceeds a predetermined value, which causes said relief valve to open, thereby discharging water under high pressure to the outside atmosphere through said port.

2. The plumbing system of claim 1 which further includes a water heater in fluid communication with said service pipe through a take-off valve, said water heater having a hot water relief valve susceptible to failure, said water heater further having a hot water outlet line with at least one water fixture, and said water heater further having a hot water return line which returns untapped hotwater to the hot water heater for reheating.

3. The plumbing system of claim 2 which further comprises:

a second circulation pump connected in line with said hot water outlet line;

a closed hot water system loop disposed between said hotwater outlet line and said hot water return line; and a second ambient temperature sensing means which activates the second circulation pump upon sensing an ambient temperature below a predetermined value, thereupon causing water in said closed hot water system loop to circulate continuously from the hotwater outlet line to the hot water return line at a desired rate to prevent freezing of said water.

4. The plumbing system of claim 1 wherein said circulation pump is actuated by means selected from the group consisting of an electronic motor, an internal combustion engine turbine.

5. A method for preventing a service pipe from freezing comprising the following steps:

installing a relief valve assembly downstream from at least one check valve in a housing for passage of water between a water main pipe and a service pipe;

installing a relief valve in said relief valve assembly, said relief valve being moveable between a closed and an open position;

providing means for controlling said relief valve so that said relief valve automatically opens in response to a high pressure condition in said service pipe which exceeds a predetermined value;

providing a port in said relief valve assembly, said port being open to the atmosphere so that said high pressure condition can be relieved;

installing a first circulation pump in line with said service pipe, the first circulation pump having an outlet and an inlet;

providing a closed cold water system loop disposed between the outlet and the inlet of the first circulation pump;

providing ambient temperature means which activates said first circulation pump upon sensing an ambient temperature below a predetermined value, said circulation pump thereupon causing water untapped by the fixture to circulate continuously through the closed cold water system loop from the outlet to the inlet of the first circulation pump at a desired rate to prevent freezing of said water, further causing said check valve to dose when circulating water pressure exceeds water pressure in the service pipe, thereby preventing untapped water from flowing back through the service pipe to the water main pipe.

6. The method of claim 5 which further comprises:

installing a water heater in fluid communication with said service pipe through a take-off valve, said water heater having a hot water relief valve susceptible to failure, said water heater further having a hot water outlet line with at least one water fixture, said water heater further having a hot water return line which returns untapped hot water to said hot water heater for reheating.

7. The method of claim 6 which further comprises:

installing a second circulation pump in line with said hot water outlet line;

providing a closed hot water system loop disposed between said hot water outlet line and said hot water return line;

providing a second ambient temperature means which activates the second circulation pump upon sensing an ambient temperature below a predetermined value, the second circulation pump thereupon causing water in the closed hot water system loop to circulate continuously from the hot water outlet line to the hot water inlet line at a desired rate to prevent freezing of the water.

* * * * *